US010781026B2

(12) United States Patent
Sato et al.

(10) Patent No.: US 10,781,026 B2
(45) Date of Patent: Sep. 22, 2020

(54) CONTAINER AND PACKAGE

(71) Applicant: SENJU METAL INDUSTRY CO., LTD., Tokyo (JP)

(72) Inventors: Isamu Sato, Tokyo (JP); Takafumi Sano, Tokyo (JP); Naoyuki Motozawa, Miyazaki (JP); Kazuya Higashi, Miyazaki (JP); Tomofumi Kaneko, Miyazaki (JP)

(73) Assignee: SENJU METAL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 16/316,014

(22) PCT Filed: Jul. 5, 2017

(86) PCT No.: PCT/JP2017/024590
§ 371 (c)(1),
(2) Date: Jan. 7, 2019

(87) PCT Pub. No.: WO2018/008668
PCT Pub. Date: Jan. 11, 2018

(65) Prior Publication Data

US 2019/0300262 A1 Oct. 3, 2019

(30) Foreign Application Priority Data

Jul. 8, 2016 (JP) ..... 2016-135876
Jul. 8, 2016 (JP) ..... 2016-135877

(51) Int. Cl.
*B65D 81/26* (2006.01)
*B65D 41/04* (2006.01)
(Continued)

(52) U.S. Cl.
CPC ..... *B65D 81/26* (2013.01); *B65D 41/045* (2013.01); *B65D 41/08* (2013.01);
(Continued)

(58) Field of Classification Search
CPC ..... B65D 81/26; B65D 41/045; B65D 41/08; B65D 43/0231; B65D 43/06; B65D 53/04;
(Continued)

(56) References Cited

U.S. PATENT DOCUMENTS 5,265,747 A 11/1993 Gregory et al.
5,443,872 A * 8/1995 Akao ..... C08K 5/1575 206/407
(Continued)

FOREIGN PATENT DOCUMENTS

EP 2617658 A1 7/2013
JP S61-161262 U 10/1986
(Continued)

OTHER PUBLICATIONS

International Search Report (in English and Japanese) and Written Opinion (in Japanese) issued in PCT/JP2017/024590, dated Aug. 15, 2017; ISA/JP.
(Continued)

*Primary Examiner* — King M Chu
*Assistant Examiner* — James M Van Buskirk
(74) *Attorney, Agent, or Firm* — Michael E. Hilton

(57) ABSTRACT

To provide a container and a package configured to prevent a deformation of housed metal. According to one aspect of the present invention, there is provided the container. This container includes a cylindrical container body, a lid, and a flat plate-shaped inner plug. The cylindrical container body with a bottom has a sidewall and a bottom wall. The lid has a flat plate portion and a side portion. The flat plate portion covers an opening of the container body. The side portion covers at least a part of an outer peripheral surface of the container body. The flat plate-shaped inner plug is located inside the lid. The container body includes a thread ridge on
(Continued)

the outer peripheral surface. The side portion of the lid has a screw groove with two or more threads on its inner peripheral surface. The lid is configured to be screwed with the container body by screwing the screw groove with the thread ridge. A plurality of lock portions are disposed on an outer periphery of the lid. The screw groove has the threads by a count identical to a count of the lock portions. The inner plug is held to an inside of the lid by each of the lock portions fitted into each inside of the screw grooves.

11 Claims, 8 Drawing Sheets

(51) Int. Cl.

| | |
|---|---|
| ***B65D 41/08*** | (2006.01) |
| ***B65D 43/02*** | (2006.01) |
| ***B65D 43/06*** | (2006.01) |
| ***B65D 53/04*** | (2006.01) |
| ***B65D 51/26*** | (2006.01) |
| ***B65D 77/04*** | (2006.01) |

(52) U.S. Cl.
CPC ..... *B65D 43/0231* (2013.01); *B65D 43/06* (2013.01); *B65D 51/26* (2013.01); *B65D 53/04* (2013.01); *B65D 77/04* (2013.01); *B65D 81/268* (2013.01); *B65D 2251/0015* (2013.01); *B65D 2251/0093* (2013.01); *B65D 2255/00* (2013.01)

(58) Field of Classification Search
CPC .... B65D 2251/0015; B65D 2251/0093; B65D 2255/00; B65D 81/268; B65D 77/04; B65D 51/26; B65D 81/24
USPC ..... 206/205
See application file for complete search history.

(56) References Cited

U.S. PATENT DOCUMENTS

| | | | | |
|---|---|---|---|---|
| 5,551,608 | A * | 9/1996 | Moore | B65D 47/06 215/232 |
| 5,927,530 | A | 7/1999 | Moore | |
| 6,425,492 | B1 | 7/2002 | Ekkert | |
| 7,182,986 | B1 | 2/2007 | Haneda et al. | |
| 8,434,614 | B2 * | 5/2013 | Sato | B65D 77/0406 206/205 |
| 8,550,306 | B2 * | 10/2013 | Angus | B65D 83/206 222/153.11 |
| 2012/0193267 | A1 | 8/2012 | Balthes | |

FOREIGN PATENT DOCUMENTS

| | | | |
|---|---|---|---|
| JP | H06-183452 | A | 7/1994 |
| JP | 2000-062820 | A | 2/2000 |
| JP | 2002-240814 | A | 8/2002 |
| JP | 4868267 | B2 | 2/2012 |
| JP | 2013505176 | A | 2/2013 |
| JP | 2013103764 | A | 5/2013 |

OTHER PUBLICATIONS

Decision to Grant a Patent issued in JP-2018-526409 (granted as JP-6418475-B2) (with English Translation) dated Sep. 13, 2018 (drafted Sep. 10, 2018).
Extended European Search Report dated Aug. 9, 2019 in corresponding European Patent Application No. 17824271.5.

* cited by examiner

CONTAINER AND PACKAGE

CROSS-REFERENCE TO RELATED APPLICATIONS

This application is the U.S. National Phase Application under 35 U.S.C. 371 of International Application No. PCT/JP2017/024590, filed on Jul. 5, 2017, which claims the benefit of priority from Japanese Patent Application Nos. 2016-135876 and 2016-135877, both filed on Jul. 8, 2016. The entire disclosures of these applications are incorporated herein by reference in their entirety.

TECHNICAL FIELD

The present invention relates to a container and a package.

BACKGROUND ART

Recently, due to a miniaturization of electronic devices, electronic components used for the electronic devices also have become significantly smaller in size, and yet constructed as multifunctional components having a number of functions. Such multifunctional components include a Ball Grid Array (BGA), a Chip Size Package (CSP), and the like to which a number of electrodes are installed. When the multifunctional component is to be mounted in a printed board, solder is applied between the electrodes and lands of the printed board.

To an electronic component, such as a Quad Flat Package (QFP) and a Small Outlined Integrated Circuit (SOIC), a bare chip including internally a number of electrodes is installed, and these electrodes are soldered to a substrate of the electronic component.

In the soldering as described above, if the solder is individually supplied to a number of installation locations or to significantly small electrodes, an excessive labor is taken. Furthermore, accurately and individually supplying fine soldered portions with the solders is difficult. Accordingly, in the soldering involving the multifunctional components or the bare chip, the solder is previously attached to the electrode to form a solder bump, and the solder bump is melted during soldering for soldering.

For formation of such solder bump, a method using a solder paste, a solder ball, or the like is used. The method using the solder paste, which is inexpensive in terms of cost, has been conventionally used predominantly. However, since a micro size of formed bump in a range of 30 to 200 μm has been requested, and a height in mounting can be further secured with the bump formed with the solder ball compared with the bump formed with the solder paste, the method using the solder ball having a diameter equal to a requested bump height has been widely used. Especially, the use of the solder balls is indispensable in an electrode for an external terminal of the BGA and the CSP or an electrode for a bare chip joining inside a component where securing the height in mounting is important.

To mount the solder balls on a number of electrodes, the solder balls are put on a pallet with holes having diameters smaller than those of the solder balls formed, and the pallet is swung. Thus, the solder balls are aligned on the holes on the pallet. Then, the solder balls are mounted on a solder ball mounting head. Accordingly, if an aspect ratio of the solder ball is large or there is an error in grain diameter, the solder ball cannot be mounted to the electrode. Thus, it is important that there is no error in grain diameter of every one of the solder balls in order to secure a precise amount of solder and secure the height in mounting.

In addition, as the solder balls become minute, a ratio of a surface area of the solder balls to total volume of the solder increases; therefore, the surfaces of the solder balls are likely to become oxidized and turn into yellow. Such yellowing is due to the fact that the solder balls are exposed to the atmosphere and Sn in the solder balls is oxidized by oxygen in the atmosphere. Since a color of an oxide film of the Sn is yellow, the thickened oxide film causes the entire solder ball to appear yellowish.

In contrast to this, there has been known a package for storing minute solder balls where containers housing the minute solder balls are made of a breathable material and a deoxidizing and drying agent arranged outside the containers is housed in a bag member together with the containers to be airtightly sealed (see PTL 1). This allows preventing the oxidization and the yellowing of the solder ball surface.

CITATION LIST

Patent Literature

PTL 1: Japanese Patent No. 4868267

SUMMARY OF INVENTION

Technical Problem

However, in a solder ball container disclosed in PTL 1, to house solder balls having a small grain diameter (for example, 0.1 mm or less), the solder ball is possibly sandwiched in a fine gap between an edge of a container body of the solder ball container and a lid material. When the solder ball is sandwiched in the above-described gap, for example, the lid material moves with respect to the edge of the container body during conveyance of the solder ball container. This squashes the solder ball, causing a problem of deterioration of sphericity of the solder ball.

In the solder ball container disclosed in PTL 1, when the solder ball is electrically charged, metal particles possibly electrostatically adsorb to an inner surface and an opening end surface of the container body when the solder ball is taken out from the container body. The electrostatic adsorption of the solder ball to the opening end surface causes the solder ball to be sandwiched between the lid member and the opening end surface of the container body when the lid member is again mounted to the container body. This makes closing the lid member difficult and deforms the solder ball.

There has been also known a container housing, for example, a copper ball, a copper core ball, and a copper column. Similarly electrically-charging such metals possibly results in electrostatic adsorption to an opening end surface of the container. Since such metal has high strength compared with a solder, a possibility that the metal is sandwiched between a lid member and the opening end surface of a container body to deform is low. However, even these metals have the possibility of deformation more or less and therefore these metals are preferably not sandwiched between the lid material and the opening end surface of the container body.

The present invention has been made in consideration of the above-described problems. One of the objects is to provide a container and a package configured to prevent a deformation of housed metal. Another object is to provide the container and the package configured to prevent metal particles from attaching to an opening end surface of a container body.

Solution to Problem

According to a first aspect, there is provided a container. This container includes a cylindrical container body, a lid, and a flat plate-shaped inner plug. The cylindrical container body with a bottom has a sidewall and a bottom wall. The lid has a flat plate portion and a side portion. The flat plate portion covers an opening of the container body. The side portion covers at least a part of an outer peripheral surface of the container body. The flat plate-shaped inner plug is located inside the lid. The container body includes a thread ridge on the outer peripheral surface. The side portion of the lid has a screw groove with two or more threads on its inner peripheral surface. The lid is configured to be screwed with the container body by screwing the screw groove with the thread ridge. The inner plug includes an inner plug body and lock portions. The lock portions are disposed on an outer peripheral portion of the inner plug body. The screw groove has the threads by a count identical to a count of the lock portions. The inner plug is held to an inside of the lid by each of the lock portions fitted into each inside of the screw grooves.

According to a second aspect, in the container of the first aspect, at least an inner surface and an opening end surface of the container body have a conductive property.

According to a third aspect, there is provided a container. This container includes a cylindrical container body, a lid, and a flat plate-shaped inner plug. The cylindrical container body with a bottom has a sidewall and a bottom wall. The lid has a flat plate portion and a side portion. The flat plate portion covers an opening of the container body. The side portion covers at least a part of an outer peripheral surface of the container body. The flat plate-shaped inner plug is located inside the lid. The container body has an opening end surface. At least an inner surface and the opening end surface of the container body have a conductive property.

According to a fourth aspect, in the container of the third aspect, the container body includes a thread ridge on the outer peripheral surface. The side portion of the lid has a screw groove with two or more threads on its inner peripheral surface. The lid is configured to be screwed with the container body by screwing the screw groove with the thread ridge. The inner plug includes an inner plug body and lock portions. The lock portions are disposed on an outer peripheral portion of the inner plug body. The screw groove has the threads by a count identical to a count of the lock portions. The inner plug is held to an inside of the lid by each of the lock portions fitted into each of the screw grooves.

According to a fifth aspect, in the container according to any one of the first to the fourth aspects, the side portion of the lid has an inner surface having a gradient such that an inner diameter gradually decreases toward the flat plate portion.

According to a sixth aspect, in the container according to any one of the first to the fifth aspects, the flat plate portion of the lid has a ring-shaped protrusion. The protrusion has a flat portion at its distal end. The lock portions are each screwed into the screw groove along the screw groove to bring the inner plug body in contact with the flat portion and to bring the lock portions in contact with an inside of the screw groove to fix the lock portions to the inside of the screw groove.

According to a seventh aspect, in the container according to any one of the first to the sixth aspects, at least the inner plug has a conductive property.

According to an eighth aspect, in the container according to any one of the first to the seventh aspects, the bottom wall and the sidewall form a corner portion inside the container body. The corner portion is rounded off.

According to a ninth aspect, in the container according to any one of the first to the eighth aspects, the bottom wall has an inner surface formed to be flat.

According to a tenth aspect, there is provided a package. This package includes a holding member, a deoxidizing and drying agent, and a bag member. The holding member includes a receptacle. The receptacle receives the container according to any one of the first to the ninth aspects. The deoxidizing and drying agent is located outside the container. The bag member is impermeable to air. The bag member houses the container, the holding member, and the deoxidizing and drying agent. The bag member is hermetically sealed.

Advantageous Effects of Invention

The present invention can provide a container and a package that can prevent a housed metal from deforming.

Additionally, the present invention can provide the container and the package that can prevent metal particles from attaching to an opening end surface of a container body.

DESCRIPTION OF EMBODIMENTS

Figure 1:
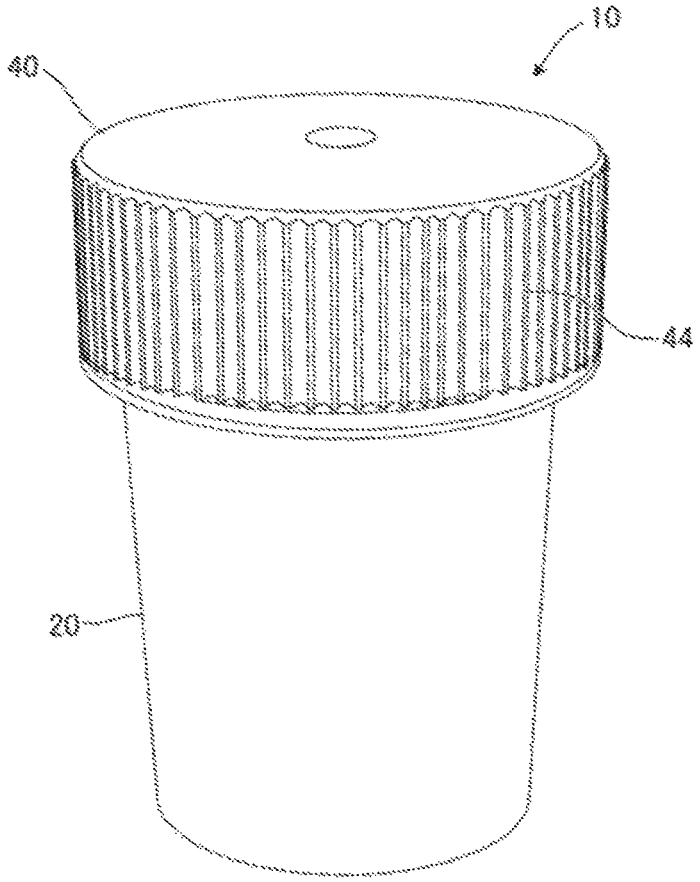
FIG. 1 is a perspective view of a container of this embodiment.

The following describes embodiments of a container and a package of the present invention with reference to the drawings. In the drawings described later, the identical reference numerals are used for the identical or equivalent components, and therefore such components will not be further elaborated here. While metal particles of any metal species, such as a copper ball, a copper column, and a copper core ball, having any shape can be housed in the container of this embodiment in addition to a solder ball, the following embodiments give a description in the case of housing the solder ball.

FIG. 1 is a perspective view of the container of this embodiment. A container 10 includes a cylindrical container body 20 with a bottom and a lid 40 to close an opening (not illustrated) of the container body 20. The container body 20 has an internal space configured to house the metal particles such as the solder ball. Closing the opening with the lid 40 closes this internal space. The lid 40 has a straight knurl 44 on the outer peripheral surface. When a user grips and rotates the lid 40 to screw the lid 40 with the container body 20, the straight knurl 44 improves a friction force of a hand of the user with the lid 40. The lid 40 does not hermetically seal the internal space of the container body 20 completely. The following describes details of structures of the container body 20, the lid 40, and an inner plug disposed inside the lid 40 constituting the container 10.

Figure 2:
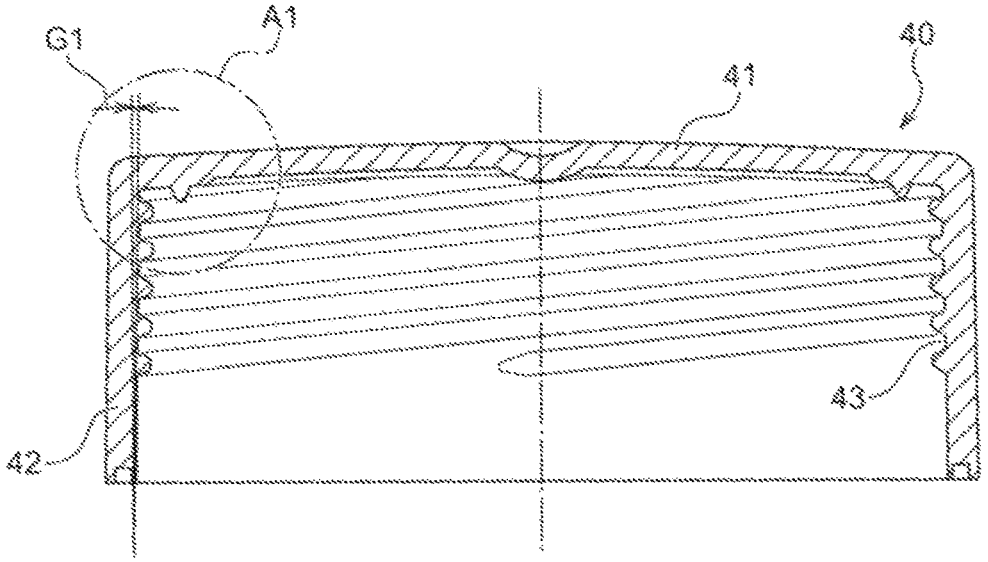
FIG. 2 is a cross-sectional view of a lid.
Figure 3:
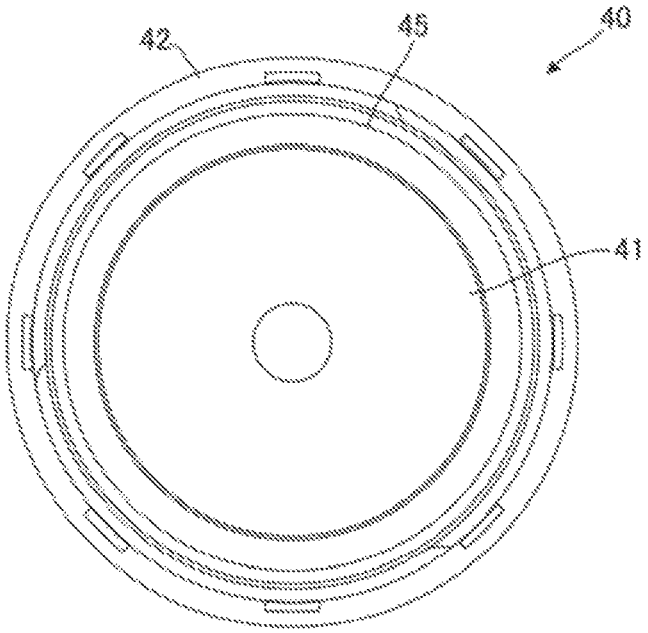
FIG. 3 is a bottom view of the lid.
Figure 4:
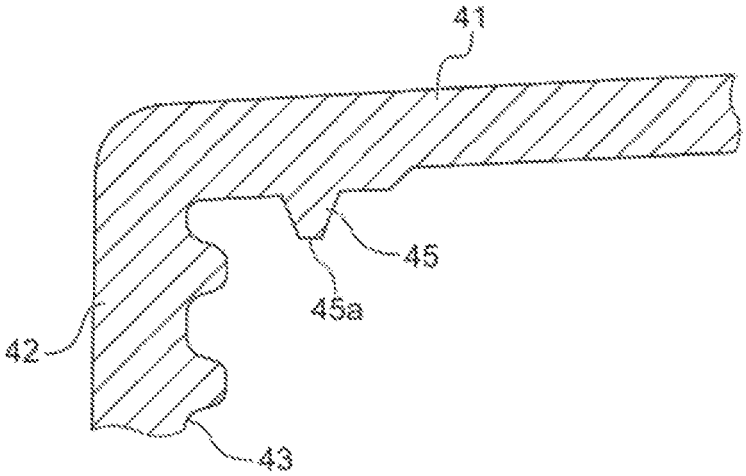
FIG. 4 is an enlarged cross-sectional side view of a part of the lid illustrated in FIG. 2.

First, the following describes the lid 40 illustrated in FIG. 1. FIG. 2 is a cross-sectional view of the lid 40, FIG. 3 is a bottom view of the lid 40, and FIG. 4 is an enlarged cross-sectional side view of a part A1 of the lid 40 illustrated in FIG. 2. The lid 40 has a conductive property in one embodiment. Specifically, the lid 40 can be made of a material having the conductive property or the surface can be coated with a conductive material. As illustrated in FIG. 2, the lid 40 includes a flat plate portion 41, which is configured so as to cover the opening of the container body 20 illustrated in FIG. 1, and a side portion 42, which is configured so as to cover at least a part of the outer peripheral surface of the container body 20. The side portion 42 is an approximately cylindrical member extending from the outer peripheral portion of the flat plate portion 41 in an approximately perpendicular direction.

A four-thread screw groove 43 is formed on the inner peripheral surface of the side portion 42. Screwing the screw groove 43 with a four-thread thread ridge 28 (see FIG. 5), which is formed on the outer peripheral surface of the container body 20, causes the lid 40 to close the opening of the container body 20. The number of threads of the screw groove 43 is not limited to four, and, insofar as the number is two or more, any number of threads is employable; however, two threads to four threads are preferred from an aspect of manufacturing.

As illustrated in FIG. 3 and FIG. 4, the flat plate portion 41 includes a protrusion 45 circularly disposed along its outer periphery. The protrusion 45 has a flat portion 45*a* at its distal end. As described later, the protrusion 45 is configured such that the inner plug is sandwiched together with an opening end surface 24 (see FIG. 5) of the container body 20 when the lid 40 is screwed with the container body 20.

As illustrated in FIG. 2, the inner surface of the side portion 42 of the lid 40 has a gradient G1 so as to gradually decrease in the inner diameter toward the flat plate portion 41. The gradient G1 is preferably about 1° or more to about 2° or less. In this embodiment, the gradient G1 is formed at about 1°. Accordingly, the inner diameter of the screw groove 43 also gradually decreases toward the flat plate portion 41.

Figure 5:
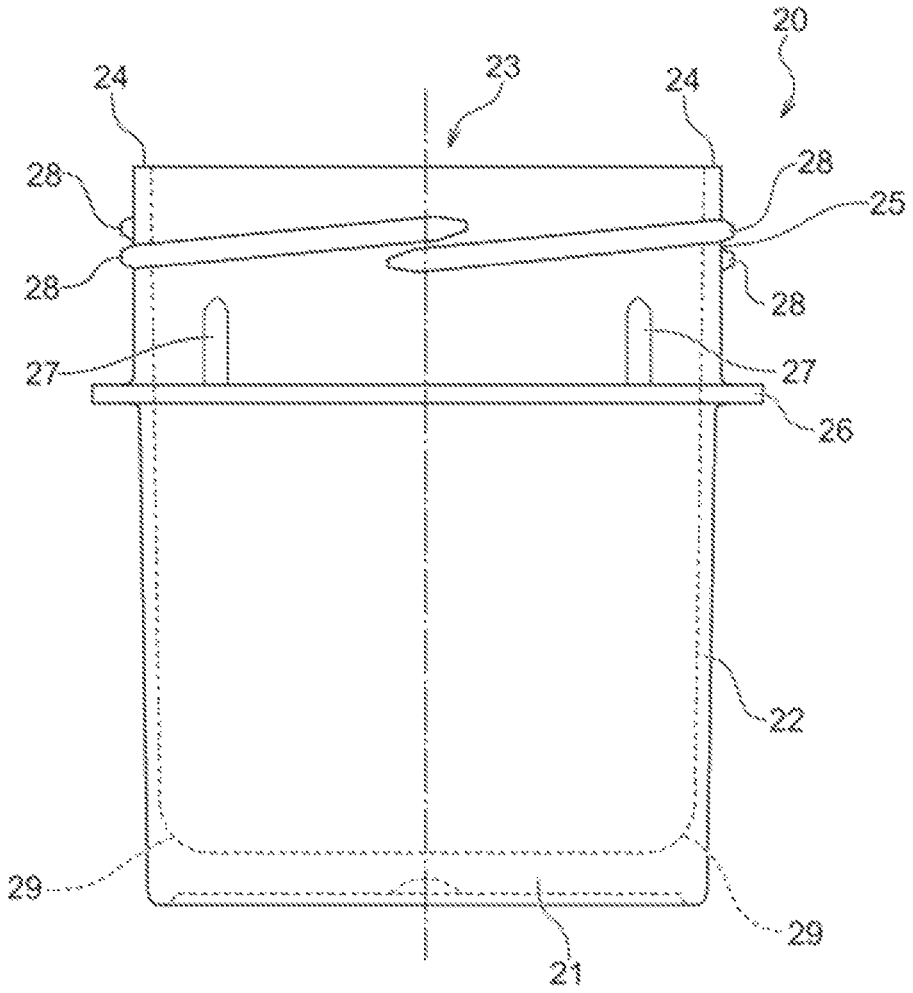
FIG. 5 is a side view of a container body.

Next, the following describes the container body 20 illustrated in FIG. 1. FIG. 5 is a side view of the container body 20. As illustrated in the drawing, the container body 20 includes a circular-flat-plate-shaped bottom wall 21 and an approximately cylindrical-shaped sidewall 22, which extends from the bottom wall 21 approximately perpendicular to the bottom wall 21. The sidewall 22 has an end portion constituting the opening end surface 24, which forms the opening 23. The sidewall 22 has an axial length configured to be larger than a diameter (outer diameter) of the bottom wall 21.

The container body 20 includes the four-thread thread ridge 28, which is disposed on the outer peripheral surface of the sidewall 22, and a screw groove 25 corresponding to the four-thread thread ridge 28. A flange 26 and a plurality of ribs 27 are formed on the outer peripheral surface of the sidewall 22 on the bottom wall 21 side with respect to the thread ridge 28. The plurality of ribs 27 axially extend from the flange 26.

As described above, the container 10 is configured so as to house any metal particles. In the case where such metal particles are electrically charged, the metal particles possibly result in electrostatic adsorption of the metal particles on the inner surface of the container 10 and the opening end surface 24 when the metal particles are taken out from the container 10. Especially, the electrostatic adsorption of the metal particles on the opening end surface 24 causes the metal particles to be sandwiched between the lid 40 and the container body 20 when the lid 40 is again mounted to the container body 20. This makes fastening the lid 40 difficult and deforms the metal particles. Therefore, in this embodiment, the container body 20 has the conductive property. For example, the container body 20 can be made of a material having the conductive property or the surface can be coated with a conductive material. More specifically, at least the inner surface of the container body 20 and the opening end surface 24 have the conductive property. For example, the inner surface of the container body 20 and the opening end surface 24 are coated with the conductive material. The known conductive materials are usable as this conductive material. This allows the static electricity of the metal particles to be released to the container body 20, thereby ensuring reducing the attachment of the metal particles to the inner surface of the container body and the opening end surface 24.

In this embodiment, the inner surface of the bottom wall 21 of the container body 20, that is, the surface inside the container body 20 is formed to be flat. Furthermore, a corner portion 29, which is formed of the bottom wall 21 and the sidewall 22, inside the container body 20 is rounded off. That is, an inner surface of a portion where the bottom wall 21 is connected to the sidewall 22 is formed to curve. The corner portion 29 has a curvature radius of, for example, 4 mm on the cross section illustrated in FIG. 5. This allows the inner surface of the container body 20 to be uniformly coated with the conductive material. Specifically, for example, when a liquid conductive material is spin-coated on the inner surface of the container body 20, since the bottom wall 21 of the container body 20 is flat, the inner surface of the bottom wall 21 is uniformly coated with the conductive material. Since the corner portion 29 is rounded off, when the conductive material is spin-coated, the conductive material can be uniformly spread along the curved corner portion 29. The method for applying the conductive material to the inner surface of the container body 20 is not limited to the spin coating and a spray and a roll coater may be used.

Figure 6:
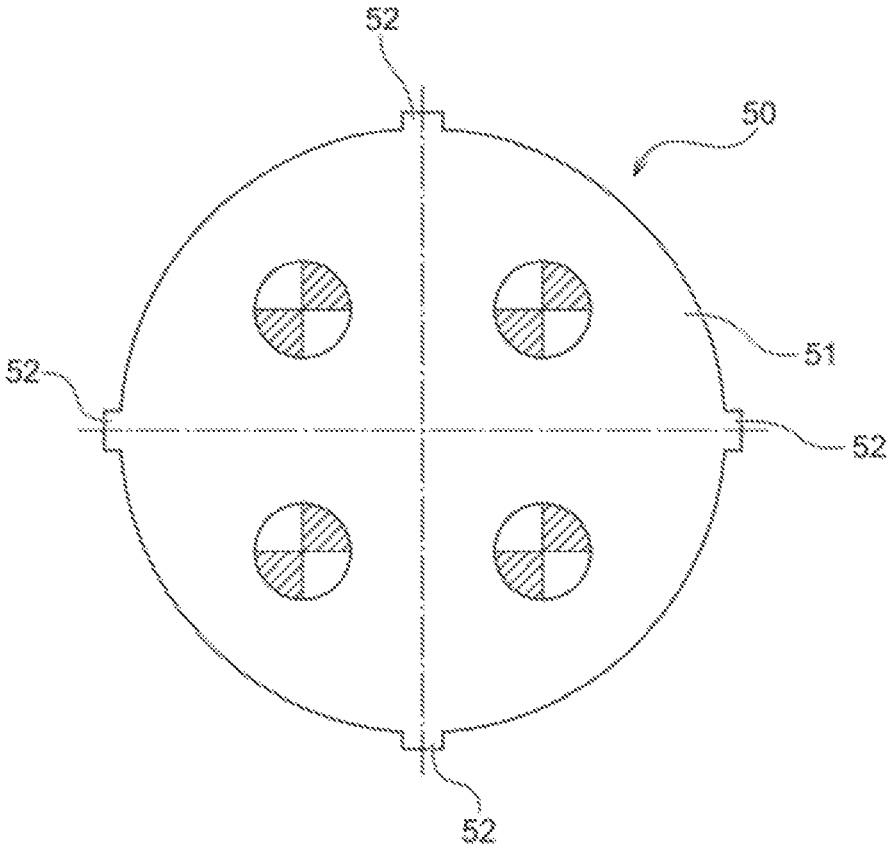
FIG. 6 is a plan view of an inner plug.
Figure 7:
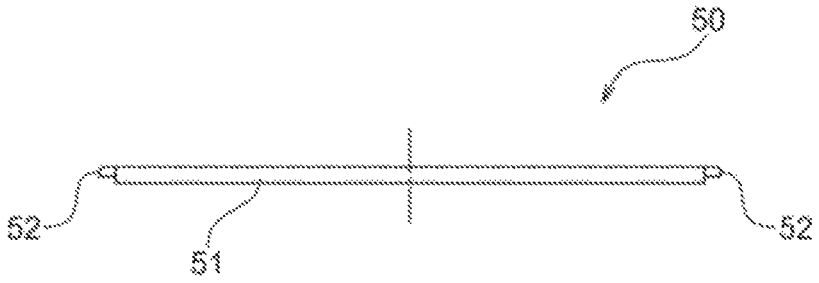
FIG. 7 is a side view of the inner plug.

Next, the following describes the inner plug provided with the container 10 illustrated in FIG. 1. FIG. 6 is a plan view of the inner plug, and FIG. 7 is a side view of the inner plug. An inner plug 50 is a flat plate-shaped member located inside the lid 40 illustrated in FIG. 1 to FIG. 4 and configured to close an opening 23 (see FIG. 5) of the container body 20 together with the lid 40. The inner plug 50 has a conductive property in one embodiment. Specifically, the inner plug 50 can be made of a material having the conductive property or the surface can be coated with a conductive material.

As illustrated in FIG. 6, the inner plug 50 includes an approximately circular-flat plate-shaped inner plug body 51 and a plurality of lock portions 52 disposed at regular intervals on the outer peripheral portion of the inner plug body 51. The lock portions 52 are, for example, approximately rectangular flat plate-shaped projections. The lock portions 52 are disposed on the inner plug 50 by the number identical to that of threads of the screw groove 43 on the lid 40 illustrated in FIG. 2 and other drawings. In this embodiment, the four lock portions 52 are disposed on the inner plug body 51. The inner plug body 51 has a thickness of, for example, about 1.3 mm, and the lock portion 52 has a thickness of, for example, about 0.7 mm. Fitting the four lock portions 52 into the four-thread screw groove 43 on the lid 40 illustrated in FIG. 2 to FIG. 4 locks the inner plug 50 to the inside of the lid 40 to be held.

Figure 8A:
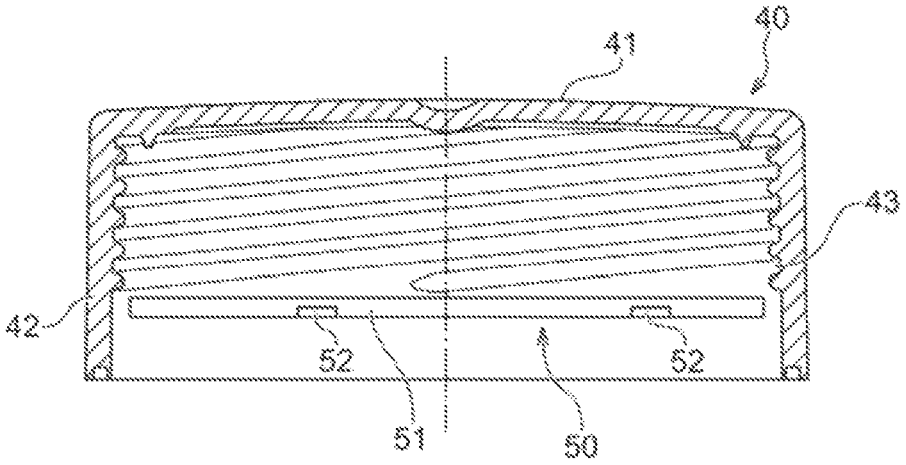
FIG. 8A is a drawing illustrating a process to hold the inner plug to the lid.
Figure 8B:
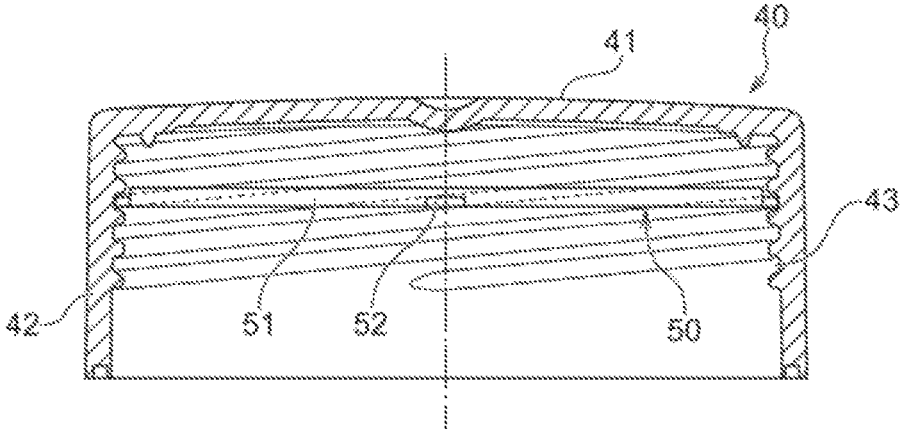
FIG. 8B is a drawing illustrating the process to hold the inner plug to the lid.
Figure 8C:
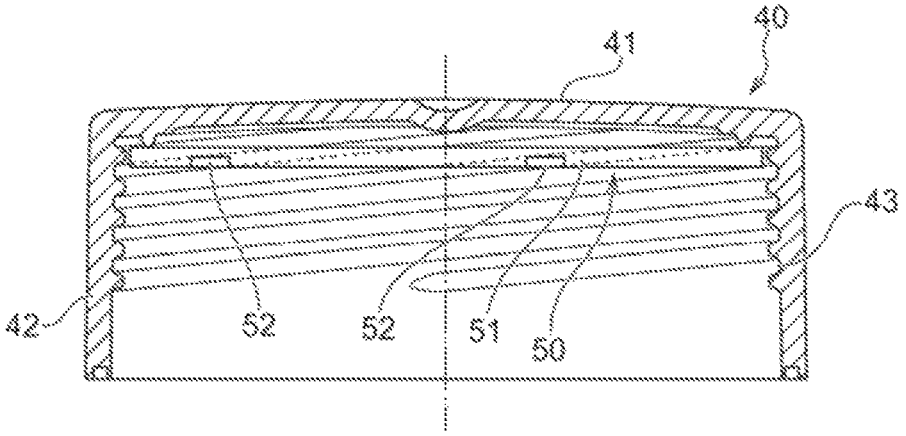
FIG. 8C is a drawing illustrating the process to hold the inner plug to the lid.

FIG. 8A to FIG. 8C are drawings illustrating a process to hold the inner plug 50 to the lid 40. As illustrated in FIG. 8A, first, the inner plug 50 is positioned inside the lid 40. At this time, the respective lock portions 52 of the inner plug 50 are inserted into respective starting ends of the screw groove 43. Subsequently, a circumferential rotation of the inner plug 50 causes the respective lock portions 52 of the inner plug 50 to move toward the inside of the lid 40 along the screw groove 43, that is, in a direction approaching the flat plate portion 41 (see FIG. 8B). Keeping the circumferential rotation of the inner plug 50 causes the inner plug 50 to move up to a position in contact with the flat portion 45*a* on the protrusion 45.

Here, the inner plug 50 includes the lock portions 52 by the number identical to that of the threads of the screw groove 43 on the lid 40, and each of the lock portions 52 is fitted into each inside of the screw groove 43. Thus, the inner plug 50 is held into the lid 40 so as to be always approximately parallel to the flat plate portion 41 of the lid 40. Accordingly, when the lid 40 is mounted to the container body 20, the inner plug 50 can be uniformly brought into contact with the opening end surface 24 (FIG. 5) of the container body 20.

Further, the inner plug 50 in contact with the flat portion 45*a* on the protrusion 45 stops the movement of the inner plug body 51 in the direction approaching the flat plate portion 41. Additional circumferential rotation of the inner plug 50 in this state moves only the lock portions 52 in the direction approaching the flat plate portion 41 along the screw groove 43. Then, the lock portions 52 contact the inside (side surface portion of the screw groove 43) of the screw groove 43 and deform along the screw groove 43. In other words, the inner plug body 51 contacts the flat portion 45*a* and the lock portions 52 contact the inside of the screw groove 43. This applies a stress from the flat portion 45*a* to the inner plug body 51 in a direction from the flat plate portion 41 toward the opening of the lid 40 (lower direction in FIG. 8A to FIG. 8C) and applies a stress from the screw groove 43 to the lock portions 52 in a direction from the opening of the lid 40 toward the flat plate portion 41 (upper direction in FIG. 8A to FIG. 8C). This generates a friction between the lock portions 52 and the inside of the screw groove 43, thus fixing the lock portions 52 of the inner plug 50 into the screw groove 43.

Figure 9:
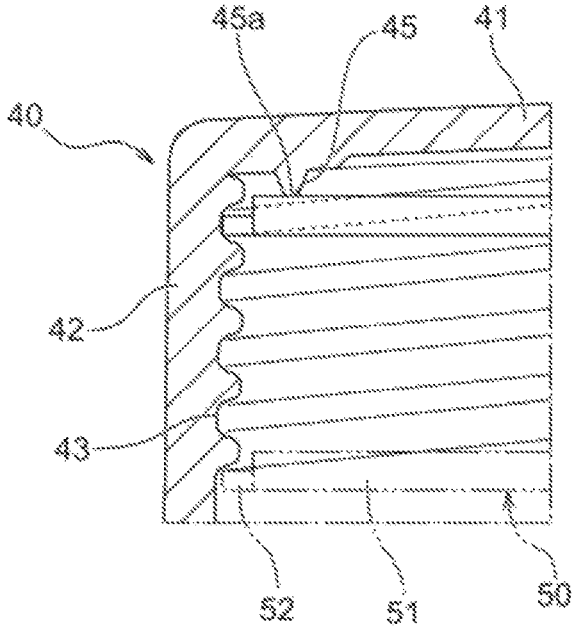
FIG. 9 is a cross-sectional view illustrating a state where the inner plug is held to an inside of the lid.

FIG. 9 is a cross-sectional view illustrating a state of the inner plug 50 held into the lid 40. As described above, the inner surface of the side portion 42 of the lid 40 has the gradient G1 (see FIG. 2) such that the inner diameter gradually decreases to the flat plate portion 41. Accordingly, as indicated by the dashed line in FIG. 9, when the inner plug 50 is positioned near the opening of the lid 40, a predetermined gap is present in a radial direction (right-left direction in the drawing) between the screw groove 43 and the lock portion 52 of the inner plug 50. Meanwhile, like the inner plug 50 indicated by the solid line in FIG. 9, when the inner plug 50 is positioned near the protrusion 45, the lock portion 52 of the inner plug 50 contacts a groove bottom portion of the screw groove 43 and generates a friction force between the screw groove 43 and the inner plug 50. This fits the lock portions 52 of the inner plug 50 into the screw groove 43 to be held or fixed.

In this embodiment, to hold the inner plug 50 into the lid 40, (i) the inner surface of the side portion 42 of the lid 40 has the gradient G1 (see FIG. 2) so as to gradually decrease the inner diameter toward the flat plate portion 41 and (ii) the inner plug body 51 is brought into contact with the flat portion 45*a* and the lock portions 52 are brought into contact with the inside (side surface portion of the screw groove 43) of the screw groove 43. However, this should not be construed in a limiting sense. The lid 40 may be configured to have any one of the above-described features (i) and (ii). Such case also allows fixing the inner plug 50 into the screw groove 43. Constituting the lid 40 so as to have both of the above-described features (i) and (ii) like this embodiment allows further reliably fixing the inner plug 50 into the screw groove 43.

Figure 10:
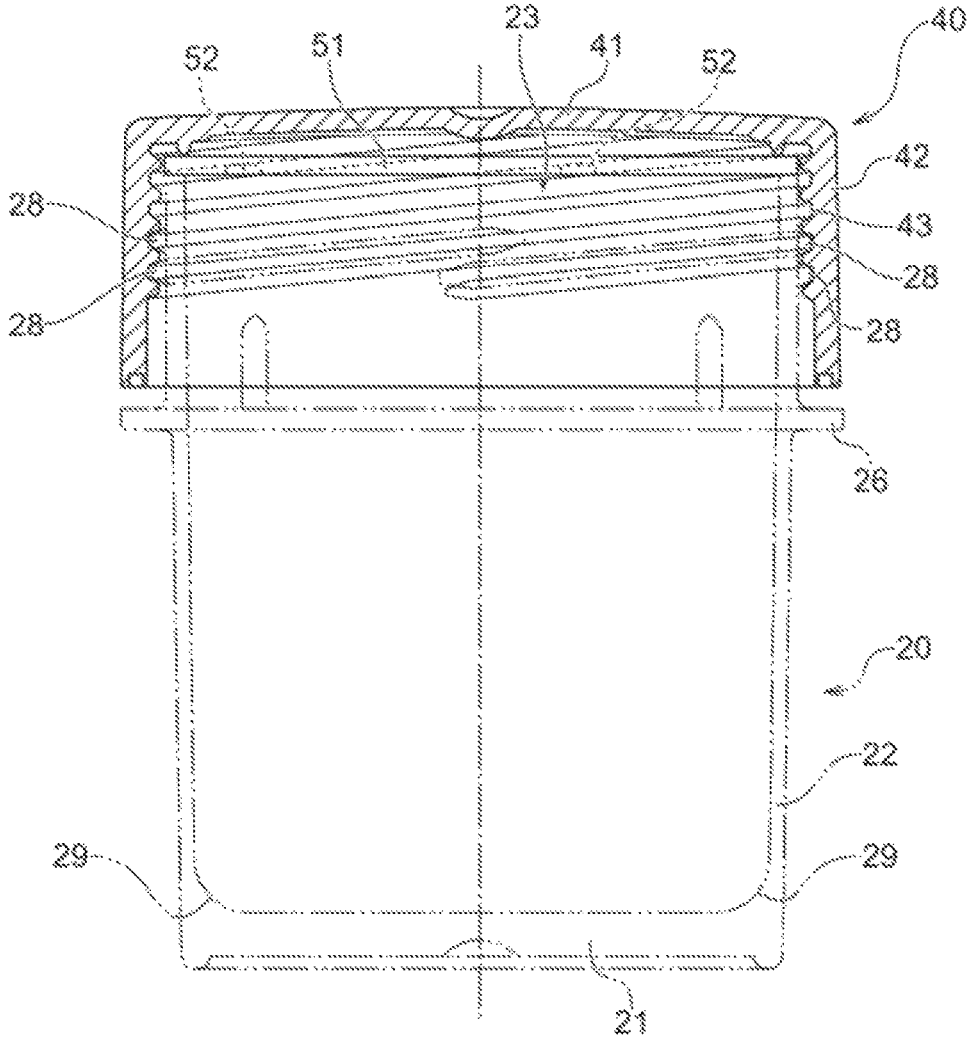
FIG. 10 is a cross-sectional view of the container in a state where an opening of the container body is closed with the lid.
Figure 11:
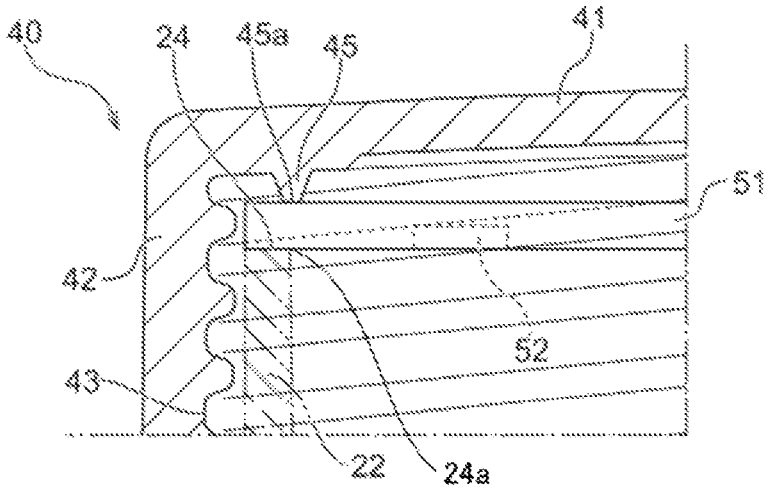
FIG. 11 is an enlarged cross-sectional view near a protrusion in the state where the opening of the container body is closed with the lid.

FIG. 10 is a cross-sectional side view of the container 10 where the opening 23 of the container body 20 is closed with the lid 40. FIG. 11 is an enlarged cross-sectional view near the protrusion 45 where the opening 23 of the container body 20 is closed with the lid 40. As illustrated in FIG. 10, the lid 40 closes the container body 20 by screwing the screw groove 43 on the lid 40 with the thread ridge 28 on the container body 20. At this time, the inner plug 50 held into the lid 40 is sandwiched between the protrusion 45 and the opening end surface 24 of the container body 20. Further, the lid 40 is screwed into the container body 20 to apply a stress to the inner plug 50 from the flat portion 45*a* on the protrusion 45 and an inner peripheral edge 24*a* of the opening end surface 24. This tightly closes the opening end surface 24 of the container body 20 with the inner plug 50.

As illustrated in FIG. 11, in this embodiment, an inner periphery diameter of the flat portion 45*a* on the protrusion 45 is designed to be smaller than the inner diameter of the inner peripheral edge 24*a* of the opening end surface 24. This applies a stress to the inner plug 50 from the flat portion 45*a* on the protrusion 45 and the inner peripheral edge 24*a* of the opening end surface 24. Accordingly, since the stress is applied to the inner plug 50 to be lineally concentrated along the inner peripheral edge 24*a* of the opening end surface 24, the opening end surface 24 of the container body 20 can be further tightly closed.

The inner plug 50 is held into the lid 40 so as to be always approximately parallel to the flat plate portion 41 of the lid 40. Therefore, when the lid 40 is mounted to the container body 20, the inner plug 50 can be uniformly brought into contact with the opening end surface 24 of the container body 20, and the gap with the inner peripheral edge 24*a* of the opening end surface 24 of the container body 20 can be uniformly decreased. Accordingly, even when metal particles having a considerably small grain diameter (for example, 0.76 mm or less) are housed in the container 10, the metal particles can be reduced to be sandwiched between the inner peripheral edge 24*a* of the container body 20 and the inner plug 50. Eventually, the deformation of the metal particles during the conveyance of the container 10 can be reduced.

With the container 10 according to this embodiment, the inner plug 50 is configured so as to be held into the lid 40 with the screw groove 43 on the lid 40. In view of this, when the container 10 is opened and closed, this configuration allows preventing the inner plug 50 from falling from the lid 40.

With the container 10 according to this embodiment, the inner plug 50 has the conductive property. Accordingly, even when the metal particles housed in the container 10 are electrically charged, the metal particles do not attach to the inner plug 50. Furthermore, the container body 20 and the lid 40 preferably have the conductive property. In this case, even if the metal particles are electrically-charged in rolling caused by, for example, an inclination of the container 10, the metal particles are diselectrified via the inner plug 50, the container body 20, and the lid 40. For the inner plug 50, the container body 20, and the lid 40 of this embodiment, a conductive resin such as a resin containing a carbon may be used or a conductive property may be provided by application of a conductive coating material. Accordingly, when the metal particles in the container 10 are moved to a pallet or similar member, this embodiment allows reducing the attachment of the metal particles to the container body 20, the lid 40, and the inner plug 50 by static electricity and their dispersion.

The container 10 according to this embodiment is configured such that the axial length of the container body 20 becomes larger than the diameter of the bottom wall 21. Accordingly, the user grips the container body 20 of the container 10 with ease. Thus, the container body 20 of the container 10 is easily gripped by the user, leading to an increased area of the hand of the user in contact with the container 10. Therefore, the static electricity on the metal particles is likely to be discharged via the hand of the user.

Figure 12:
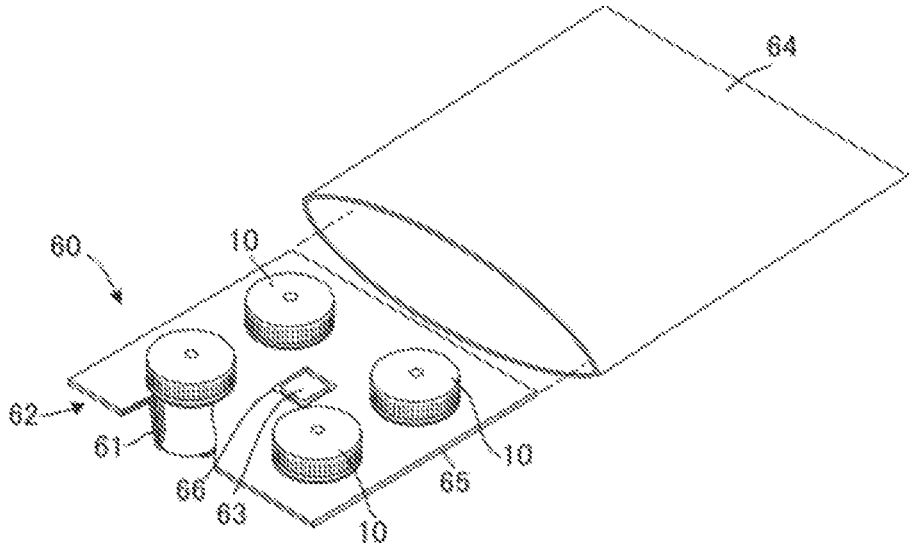
FIG. 12 is a drawing illustrating a state of a package before hermetic seal.
Figure 13:
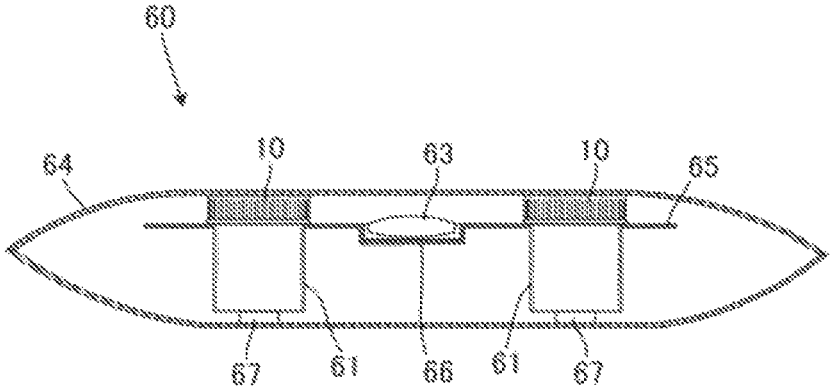
FIG. 13 is a vertical cross-sectional view of the package after the hermetic seal.

Next, the following describes the package according to this embodiment. FIG. 12 is a drawing illustrating a state of the package before hermetic seal, and FIG. 13 is a vertical cross-sectional view of the package after the hermetic seal. As illustrated in FIG. 12, a package 60 includes the containers 10 described in FIG. 1 to FIG. 11, a holding member 62 to hold the container 10, a deoxidizing and drying agent 63, and a bag member 64 that houses the container 10, the holding member 62, and the deoxidizing and drying agent 63 for sealing in the hermetic seal state.

The holding member 62 includes a flat plate-shaped plate member 65, receptacles 61 to receive the container 10, and a depressed portion 66 to locate the deoxidizing and drying agent 63. In this embodiment, the holding member 62 includes the four receptacles 61 to hold the four containers 10. The plurality of containers 10 are each housed in the receptacle 61 on the holding member 62, thus maintaining mutual relative positions. The depressed portion 66 is disposed at an approximately center of the four receptacles 61 such that the deoxidizing and drying agent 63 is positioned at a location separated from the respective holding members 62 housed in the receptacles 61 at approximately equal distances.

As illustrated in FIG. 13, buffering bulges 67 are formed at the respective lower portions of the receptacles 61 for reduction of an impact from outside. The impact from outside in this case is, for example, an impact due to a fall of the package 60.

To pack the containers 10, first, the metal particles such as the solder balls are put into the containers 10. Afterwards, the containers 10 are housed in the receptacles 61 on the holding member 62, and the deoxidizing and drying agent 63 is located at the depressed portion 66. A pressing member or similar member that presses the deoxidizing and drying agent 63 against the depressed portion 66 may be disposed to avoid the deoxidizing and drying agent 63 to drop from the depressed portion 66.

Subsequently, the containers 10, the holding member 62, and the deoxidizing and drying agent 63 are put in the bag member 64. Hermetically sealing the end portion of the bag member 64 hermetically seals the containers 10, the holding member 62, and the deoxidizing and drying agent 63 as illustrated in FIG. 10.

The bag member 64 is made of a material impermeable to air. As a material used for the bag member 64, a material with sufficiently low oxygen permeability and water vapor permeability is employed. The oxygen permeability preferably exhibits a daily volume of oxygen permeating a sheet of 10 ml or less per 1 $m^2$ of the sheet under an environment having a temperature of 23° C., a humidity of 0% and an atmospheric pressure of 1 MPa. The water vapor permeability preferably exhibits a daily volume of moisture permeating the sheet of 1 gram or less per 1 $m^2$ of the sheet under an environment having a temperature of 40° C. and a relative humidity of 90%. The bag member 64 can be made of, for example, an aluminum sheet material. Alternatively, the bag member 64 made of an air permeable material may be coated with an aluminum or the like so as to provide the bag member 64 with impermeability to air.

Further, the deoxidizing and drying agent 63 is one having a deoxidization function and absorbing moisture so as to prevent oxidization of a subject caused by oxygen and moisture. A commercially available product, for example, a RP agent (product name of a product from MITSUBISHI GAS CHEMICAL COMPANY, INC.) is usable as the deoxidizing and drying agent.

As described above, the lid 40 for the container 10 does not hermetically seal the internal space of the container body 20 completely. In view of this, housing the containers 10 in the bag member 64 together with the deoxidizing and drying agent 63 absorbs oxygen and moisture in an internal atmosphere of the containers 10 by the deoxidizing and drying agent 63, thus ensuring preventing the oxidation of the metal particles.

The number of containers 10 held by the holding member 62 is not limited to four. The increase and decrease in the number of receptacles 61 can appropriately increase and decrease the number of containers 10 capable of being held by the holding member 62. In the case where the number of containers 10 held by the holding member 62 is further increased, the number of deoxidizing and drying agents 63 may be increased.

When the containers 10 are used, the bag member 64 of the package 60 illustrated in FIG. 13 is partially broken, and the holding member 62 is taken out from the bag member 64. The lids 40 for the containers 10 are removed and the metal particles in the containers 10 are supplied on a pallet. With the unused containers 10 housed in the holding member 62, the unused containers 10 are returned into the bag member 64 together with a new unused deoxidizing and drying agent 63. The broken part of the bag member 64 is closed by applying a reliable seal such as thermocompression bonding to avoid ingress of outside air. In the case where not all of the metal particles in the single container 10 are consumed, the container 10 is closed by the lid 40, returned into the holding member 62, and then housed into the bag member 64. Thus, the bag member 64 is resealed.

The embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited.

REFERENCE SIGNS LIST

10 . . . container
20 . . . container body
21 . . . bottom wall
22 . . . sidewall
23 . . . opening
24 . . . opening end surface
24*a* . . . inner peripheral edge
28 . . . thread ridge
29 . . . corner portion
40 . . . lid
41 . . . flat plate portion
42 . . . side portion
43 . . . screw groove
45 . . . protrusion
45*a* . . . flat portion
50 . . . inner plug
51 . . . inner plug body
52 . . . lock portion
60 . . . package
61 . . . receptacle
62 . . . holding member
63 . . . deoxidizing and drying agent
64 . . . bag member
G1 . . . gradient

The invention claimed is:

1. A container comprising:
a cylindrical container body with a bottom having a sidewall and a bottom wall;
a lid having a flat plate portion and a side portion, the flat plate portion covering an opening of the container body, the side portion covering at least a part of an outer peripheral surface of the container body; and
a flat plate-shaped inner plug located inside the lid, wherein
the container body includes a thread ridge on the outer peripheral surface,
the side portion of the lid has a screw groove with starting ends on its inner peripheral surface,
the lid is configured to be screwed with the container body by screwing the screw groove with the thread ridge,
the inner plug includes an inner plug body and lock portions, the lock portions being disposed on an outer peripheral portion of the inner plug body,
the screw groove has the starting ends in a count that is two or more and that is identical to a count of the lock portions,
the inner plug is held to an inside of the lid by each of the lock portions fitted into each of the screw grooves with the inner plug, including the inner plug body and the lock portions, having a flat shape.

2. The container according to claim 1, wherein
at least an inner surface and an opening end surface of the container body have a conductive property.

3. The container according to claim 1, wherein
the side portion of the lid has an inner surface having a gradient such that an inner diameter gradually decreases toward the flat plate portion.

4. The container according to claim 1, wherein
at least the inner plug has a conductive property.

5. The container according to claim 1, wherein
the bottom wall and the sidewall form a corner portion inside the container body, the corner portion being rounded off.

6. The container according to claim 1, wherein
the bottom wall has an inner surface formed to be flat.

7. A package comprising:
a holding member that includes a receptacle, the receptacle receiving the container according to claim 1,
a deoxidizing and drying agent located outside the container, and
a bag member impermeable to air, the bag member housing the container, the holding member, and the deoxidizing and drying agent, the bag member being hermetically sealed.

8. A container comprising:
a cylindrical container body with a bottom having a sidewall and a bottom wall;
a lid having a flat plate portion and a side portion, the flat plate portion covering an opening of the container body, the side portion covering at least a part of an outer peripheral surface of the container body; and
a flat plate-shaped inner plug located inside the lid, wherein
the container body has an opening end surface,
at least an inner surface and the opening end surface of the container body have a conductive property,
the container body includes a thread ridge on the outer peripheral surface,
the side portion of the lid has a screw groove with starting ends on its inner peripheral surface,
the lid is configured to be screwed with the container body by screwing the screw groove with the thread ridge,
the inner plug includes an inner plug body and lock portions, the lock portions being disposed on an outer peripheral portion of the inner plug body,
the screw groove has the starting ends in a count that is two or more and that is identical to a count of the lock portions,
the inner plug is held to an inside of the lid by each of the lock portions fitted into each of the screw grooves with the inner plug, including the inner plug body and the lock portions, having a flat shape.

9. A package comprising:
a holding member that includes a receptacle, the receptacle receiving the container according to claim 8,
a deoxidizing and drying agent located outside the container, and
a bag member impermeable to air, the bag member housing the container, the holding member, and the deoxidizing and drying agent, the bag member being hermetically sealed.

10. A container comprising:
a cylindrical container body with a bottom having a sidewall and a bottom wall;

a lid having a flat plate portion and a side portion, the flat plate portion covering an opening of the container body, the side portion covering at least a part of an outer peripheral surface of the container body; and a flat plate-shaped inner plug located inside the lid, wherein the container body has an opening end surface, at least an inner surface and the opening end surface of the container body have a conductive property, the flat plate portion of the lid has a ring-shaped protrusion, the protrusion has a flat portion at its distal end, the inner plug includes an inner plug body and lock portions, the lock portions being disposed on an outer peripheral portion of the inner plug body, the lock portions are each screwed into the screw groove along the screw groove to bring the inner plug body in contact with the flat portion and to bring the lock portions in contact with an inside of the screw groove to fix the lock portions to the inside of the screw groove, with the inner plug, including the inner plug body and the lock portions, having a flat shape.

11. A package comprising:

a holding member that includes a receptacle, the receptacle receiving the container according to claim 10, a deoxidizing and drying agent located outside the container, and a bag member impermeable to air, the bag member housing the container, the holding member, and the deoxidizing and drying agent, the bag member being hermetically sealed.

* * * * *